United States Patent [19]

Strauss et al.

[11] 3,996,973

[45] Dec. 14, 1976

[54] DRIVE SHAFT FOR SWINGING OF REED TEETH

[75] Inventors: Edgar Strauss; Xaver Gsell, both of Ruti, Switzerland

[73] Assignee: Ruti Machinery Works Ltd., Ruti, Switzerland

[22] Filed: July 7, 1975

[21] Appl. No.: 593,483

[30] Foreign Application Priority Data

Aug. 29, 1974 Switzerland ..... 11769/74

[52] U.S. Cl. ..... 139/436

[51] Int. Cl.[2] ..... D03D 47/26

[58] Field of Search ..... 139/12, 13, 29; 74/567, 74/568 R, 568 FS, 568 M

[56] References Cited

UNITED STATES PATENTS

| | | | |
|---|---|---|---|
| 1,708,164 | 4/1929 | Widell | 74/567 |
| 2,041,053 | 5/1936 | Dunham | 74/567 |
| 3,687,171 | 8/1972 | Strauss | 139/12 |

*Primary Examiner*—Henry S. Jaudon
*Attorney, Agent, or Firm*—Donald D. Denton

[57] ABSTRACT

Shaft arrangement for the swinging of reed teeth in a wave-type loom in which at least one lubricating groove extends the length of the shaft that drives the swinging of the reed teeth.

11 Claims, 9 Drawing Figures

DRIVE SHAFT FOR SWINGING OF REED TEETH

BACKGROUND OF THE INVENTION

The present invention relates to a drive shaft serving for the pivoting of the reed teeth about a pivot for a wave-type loom in which the reed teeth are formed of elongated thin blades, the wide sides of which are perpendicular to the shaft and which have one edge resting against the shaft.

Wave-type or undulating looms with blade-shaped reed teeth are known in which the latter are so moved by means of screw shafts, i.e. drive shafts which have a helical profile, that they as a whole carry out an undulatingly progressive movement and thereby beat the filling threads against the fell of the cloth. It is also known to use the undulatingly progressive movement of the reed teeth simultaneously for advancing the filling thread insertion members or shuttles.

In these undulating looms, the blade-shaped reed teeth have their wide sides perpendicular to the screw shafts which swing or pivot them about a pivot shaft around which they swing to lie with their narrow sides on the drive shafts. Accordingly, there is the danger that during the course of operation the blades will gradually work their way into the drive shafts producing thin grooves in the latter. As a result, the amount of swing or pivoting motion of the blades becomes inaccurate which in turn causes an irregular beat-up of the cloth.

It has been attempted to produce screw shafts of steel and provide them with a hardened chrome layer in order to prevent the formation of grooves. This measure however has failed to produce the desired results. In particular it has been found that in the case of metal reed teeth, contact rust is formed or wear of the reed teeth takes place.

For this reason screw shafts whose outer layer consists of plastic have been employed. If the plastic is arranged over an inner core of metal in such a shaft, the shaft is imparted the necessary strength. However, the blades still cut-in to such an extent that the life of the screw shaft must be considered insufficient for use on a loom. Since the reed teeth extend between the warp threads, when one of the customary types of lubrication is used, the cloth to be formed is dirtied. Furthermore, a resinification of the reed teeth takes place whereby the movement of the reed teeth is strongly impeded with the result that an increased load is exerted on the screw shaft by the reed teeth during operation.

The closest prior art known to applicants in connection with this application is U.S. Pat. No. 3,687,171.

SUMMARY OF THE INVENTION

The above discussed disadvantages are avoided by the present invention. The invention is characterized by the fact that the drive shaft for the swinging or pivoting of the reed teeth of a traveling wave or an undulating loom is provided with at least one groove which extends along the length of the shaft, and that a supply of a lubricant is present within the groove.

BRIEF DESCRIPTION OF THE DRAWINGS

The invention will now be explained in further detail on the basis of the following examples and with reference to the drawings, in which.

DESCRIPTION OF PREFERRED EMBODIMENTS

Figure 1:
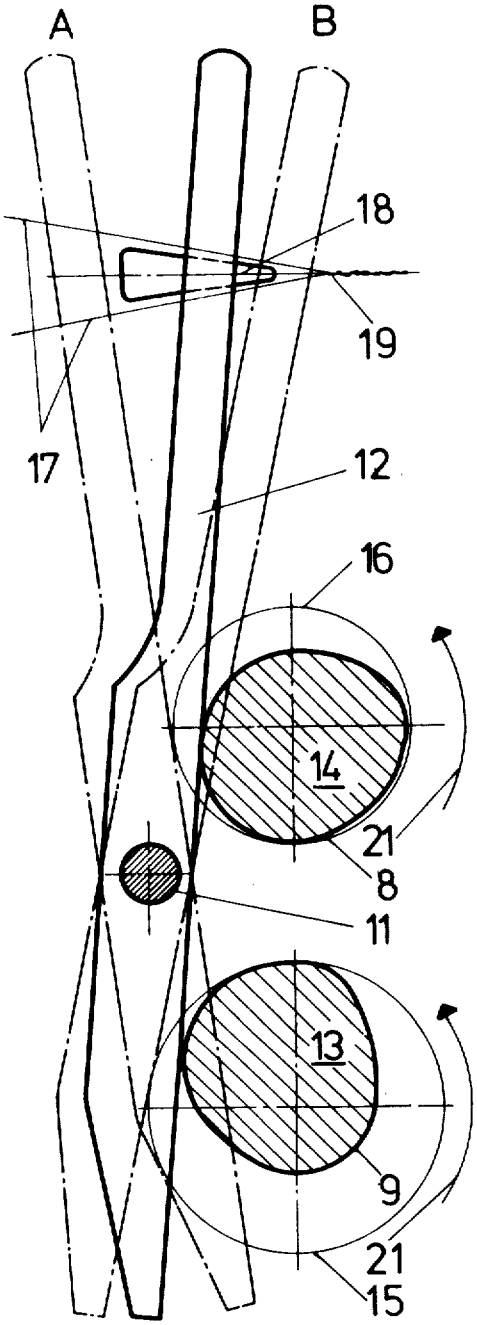
FIG. 1 shows a vertical cross-sectional view through an arrangement of swingable reed teeth.

A large number of reed teeth 12 are arranged swingable about a pivot shaft 11 which is shown in cross-section in FIG. 1. Reed teeth 12 have the shape of thin elongated blades whose wide sides are positioned perpendicular to the pivot shaft 11, the reed teeth being positioned at small regular distances from each other. Two screw or reed teeth drive shafts 13, 14 serve to swing or pivot the reed teeth 12 about pivot axis 11. Each of these screw shafts is provided with a profile 15, 16 which extends helically along the shaft (see FIGS. 2 and 4). In this connection the profiles 15, 16 of the shafts 13 and 14 supplement each other in the manner that upon their rotation in the direction indicated by the arrows 21, they continuously rest against the reed teeth 12 whereby the latter are always held and positively guided in their swinging movements as they are pivoted around the shaft 11.

The reed teeth 12 extend through the shed formed by warp threads 17. Between adjacent reed teeth 12 there are arranged one or more warp threads 17. A large number of sheds is present over the width of the loom. In each individual shed there is provided a filling introduction member or shuttle 18. The woven cloth is designated by 19.

In addition to the beating-up of the filling threads, the movement of the reed teeth 12 towards the cloth can also be used for the advancing of the shuttles 18. For this purpose the shuttles are provided with an oblique rear edge. When the reed teeth 12 strike against this rear edge, they force the shuttles 18 forward. The movement of the reed teeth 12 towards the cloth serves in particular for the beating of the filling threads coming from the shuttles 18 against the fell of the cloth. For this beating-up of the filling threads, a considerable force must be exercised on the reed teeth 12 by the screw shaft 13. During the operation of the loom, this force represents the greatest load acting on the screw shaft 13.

Figure 2:
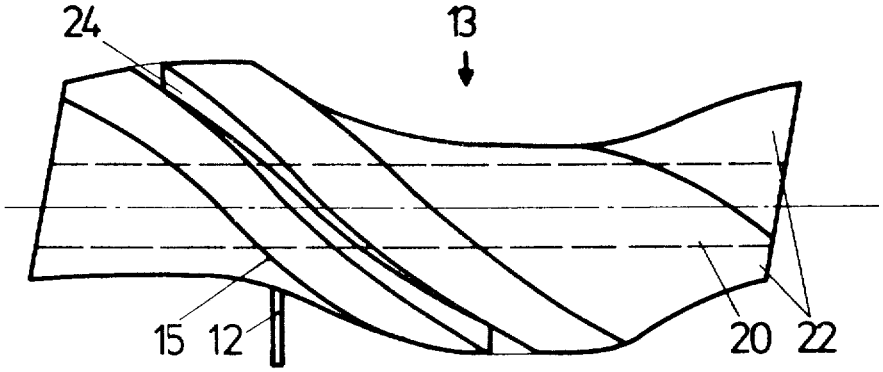
FIGS. 2 and 4 show side views of portions of screw shafts for producing the swinging of the reed teeth.
Figure 3:
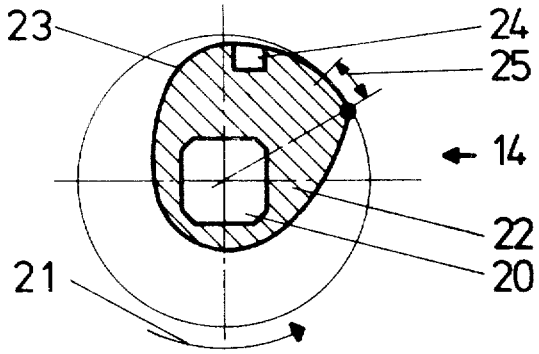
FIGS. 3 and 5 show cross-sectional views of screw shafts according to FIGS. 2 and 4, respectively, taken at right angles to the run of the screw shafts.

In FIG. 2 a portion of a screw shaft 13 is seen as viewed from the side. The screw shaft 13 consists of a center piece 20 of metal which is surrounded by a jacket 22 consisting of plastic. (See FIG. 3.) The profile 15 serves to produce swinging movements of the reed teeth 12. For the sake of completeness, a single reed tooth 12 is also included in the drawing. The metal center piece 20 is not shown in FIG. 1.

When the shafts 13, 14 turn in the direction of rotation indicated by the arrow 21 when the loom is in operation, the reed teeth 12 are thereby caused to carry out swinging motions which take place around the pivot axis 11. The extreme positions of the reed teeth 12 are shown in dash-dot line and designated A and B. The swinging motion of the reed teeth 12 in the direction towards the cloth 19 is effected by the pressing of the profile 15 against the reed tooth 12 and the movement of the reed tooth 12 away from the cloth 19 takes place by the pressing of the profile 16 against the reed tooth 12. As a result of this manner of operation, grooves can in time be produced on the surface of the screw shafts 13, 14 or in the pivot shaft 11.

As mentioned at the start, different types of solution were tried out, in which connection the idea of effecting the beating-up of the filling thread by means of rotating disks also came up. As compared with this, however, swinging reed teeth 12 have the substantial advantage that they strike the filling thread with a movement which is perpendicular to the cloth 19 and the beating edge and that the warp threads 17 remain at all times between the reed teeth 12 so that the dipping of disk parts between the warp threads, necessary upon each rotation in the case of rotating disks, together with the great disadvantages caused thereby are not present.

It has now been found that a great increase in the life of the shafts 11, 13, and 14 is obtained if only extremely slight lubrication is provided. In this connection, it has been found that a minimal dosaging of the lubricant must be used for the lubrication. To accomplish this, a groove 24 is arranged in the screw shaft 13 and a wick-like lubricant holder is inserted in the groove 24, it being impregnated with a lubricant. The lubricant holder must be of such a nature that it contains as much lubricant as possible but only gives off an extremely small amount of lubricant. A lubricant holder in the form of a stuffing box packing consisting of textile braid which has a relatively dense surface has proven advantageous. The amount of lubricant therein can amount to more than 50% of the volume of the support. It may consist of flexible material but should be as resistant as possible to wear.

As already mentioned, the greatest pressure on the reed teeth 12 is necessary for the beating-up of the filing thread. It is most advantageous for the groove 24 to be arranged directly in front of the point of greatest pressure. In the embodiment shown in FIGS. 2 and 3, the reed tooth 12 rests against the screw shaft 13 in the region 25, when the beating-up of the thread takes place. With the direction of rotation indicated by 21, the groove 24 containing the lubricant is accordingly somewhat in front of this region 25 whereby the lubricant is transferred upon each revolution from the groove 24 to the reed tooth 12 and from the reed tooth to the region of action 25.

Figure 4:
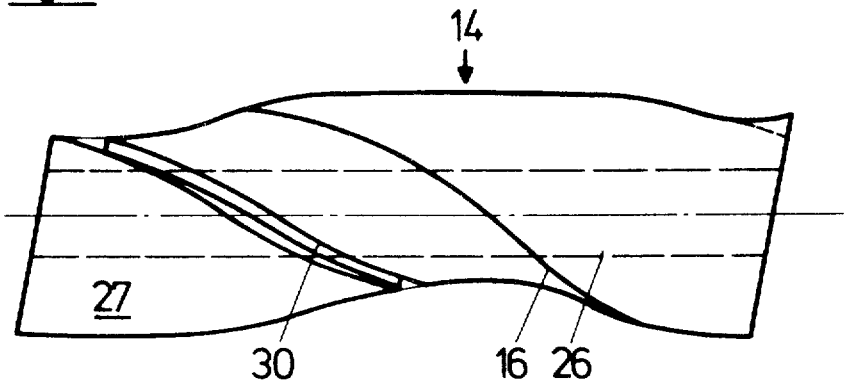
Figure 5:
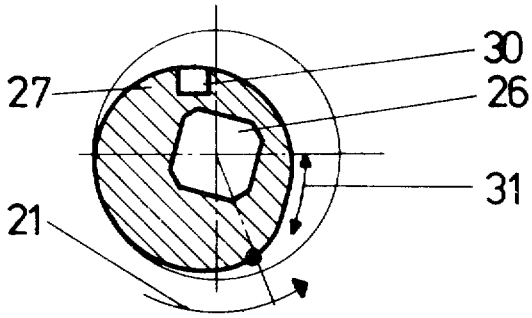

In FIGS. 4 and 5 the screw shaft 14 is shown. Over a metal center 26 there is arranged a jacket 27 of plastic having the profile 16. In the groove there is similarly present a holder or holder means impregnated with a lubricant, said holder advantageously also being in the shape of a wick-like structure.

In the case of the screw shaft 14, the greatest load is present when the reed tooth 12 is accelerated out of its beating-up position, i.e. in the region 31. However, directly in front of this region as referred to the direction of rotation 21, the jacket 27 is relatively thin so that it is advisable to move the groove 30 forward to such an extent that it comes to lie in a relatively thicker part of the jacekt 27. The transfer of the lubricant from the groove 30 via the reed tooth 12 to the region of pressure 31 is nevertheless assured.

Figure 6:
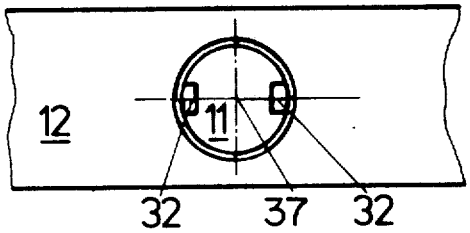
FIG. 6 is a cross-sectional view through the axis of rotation of the reed teeth.

Upon the swinging movements of the reed teeth 12, an edge of the reed teeth rests or abuts with friction also against the shaft 11. It is therefore advisable to provide a similar lubrication for this shaft 11. As shown in FIG. 6, the shaft 11 is provided with two grooves 32 which extend parallel to the axis 37 of the shaft 11 and are arranged opposite each other with respect to the shaft, and in each of which there is a lubricant holder. In this connection it may be mentioned that the conditions in connection with the shaft 11 are less critical. This is due to the fact that the relative speed between the edge of the blade 12 resting on the shaft and the surface of the shaft 11 is smaller than in the case of the shafts 13, 14.

It has been found, particularly in the case of the screw shafts 13, 14, that after a certain period of operation of for instance several months, the lubricant has migrated to the outside and the lubricant support has become dry, particularly in its inner region. It appears that the centrifugal force caused by the rotation plays an essential part in this. Another advantageous embodiment thus provides a special storage space for lubricant.

Figure 7:
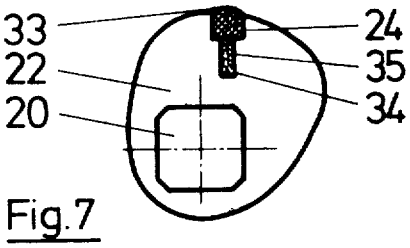
FIGS. 7 and 8 show cross-sectional views which show further developments of the shaft in accordance with the invention.

FIG. 7 shows the lubricant support or holder means 33 located in the groove 24. Along the inner side or bottom surface of the groove 24 there is provided a second groove 34 serving as storage space and extending parallel to the groove 24. The groove 34 is filled with a lubricant 35 so that the latter passes slowly during the operation of the loom through the wick 33 of the lubricant holder means and contributes to a proper amount of lubrication being automatically dispensed.

Figure 8:
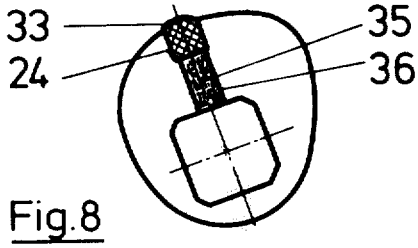
Figure 9:
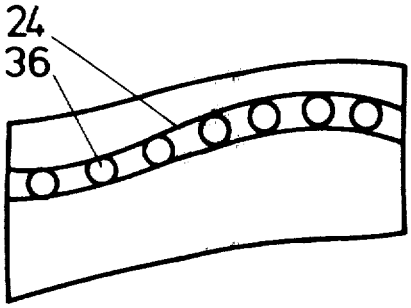
FIG. 9 shows a side view of a portion of the screw shaft of FIG. 8.

Another example of a storage space for lubricant is shown in FIGS. 8 and 9. In FIG. 9 the lubricant holder is not shown. In accordance with this example bore holes 36 are provided at relatively small distances apart along the groove 24, lubricant 35 being introduced into said bore holes. In this case also during the operation of the loom, the lubricant migrates slowly towards and into the lubricant holder means 33. There it distributes itself in the longitudinal direction of the holder means as a result of capillary forces.

As lubricant there is recommended in particular one that evaporates as slowly as possible. Furthermore, it should be as resistant chemically as possible and be adapted to the material of which the screw shaft is made. For this purpose highly viscous greases are suitable, such as for instance those employed for vacuum pumps. Greases which contain natural wax or paraffin wax have also proven suitable.

Polyoxymethylene type plastic has proven to be particularly suitable as material for the jackets 22, 27 as well as for the shaft 11.

It will be appreciated that various changes and modifications may be made within the skill of the art without departing from the spirit and scope of the invention illustrated, described, and claimed herein.

What is claimed is:

1. Shaft arrangement on a traveling wave loom for the pivoting of the reed teeth during the operation of the loom in which reed teeth are formed of elongated thin blades, the wide sides of which are perpendicular to a helically profiled contracting surface of a rotating screw shaft of said shaft arrangement and one edge of each abuts against the surface of said shaft, at least one lubricating groove extending the length of said shaft for supplying lubricant between the contacting surfaces of said surface and said one edge abutting against said surface and a lubricant holder means which is impregnated with a lubricant being contained in said groove, said groove following the profile of said shaft so as to always be forward of the point of maximum pressure between said surface and said one edge.

2. The shaft arrangement according to claim 1 in which the shaft about which the reed teeth pivot has at least two grooves which extend parallel to the shaft axis and are arranged with rotational symmetry with respect to the latter.

3. The shaft arrangement according to claim 1 in which the lubricant is substantially nonvolatile and chemically stable.

4. The shaft arrangement according to claim 1 in which the lubricant is in the form of a grease.

5. The shaft arrangement according to claim 1 in which the lubricant contains natural wax and the surface of the shaft is formed from polyoxymethylene-type plastic.

6. The shaft arrangement according to claim 1 in which the lubricant contains paraffin wax and the surface of the shaft is formed from polyoxymethylene-type plastic.

7. The shaft arrangement according to claim 1 in which the lubricant holder means is formed of a textile braid.

8. The shaft arrangement according to claim 1 in which the lubricant holder means has a relatively dense surface and consists of relatively wear-resistant material.

9. The shaft arrangement according to claim 1 in which the groove is open below the lubricant holder means towards at least one interconnected storage space for containing a supply of lubricant.

10. The shaft arrangement according to claim 9 in which the groove is of rectangular cross-section and along its bottom surface there extends a second groove serving as lubricant storage space which second groove is narrower than said first groove.

11. The shaft arrangement according to claim 9 in which hollow spaces are provided at regular distances apart from each other serving as lubricant storage spaces along the groove from the bottom surface of the groove towards the inside of the shaft.

* * * * *